United States Patent [19]

Perlman

[11] Patent Number: 4,877,585

[45] Date of Patent: Oct. 31, 1989

[54] DILUTION PIPETTE DEVICE

[75] Inventor: Daniel Perlman, Arlington, Mass.

[73] Assignee: Brandeis University, Waltham, Mass.

[21] Appl. No.: 130,406

[22] Filed: Dec. 9, 1987

[51] Int. Cl.[4] ..... B01L 3/02

[52] U.S. Cl. ..... 422/100; 436/180; 73/864.01

[58] Field of Search ..... 422/100; 73/864.01; 436/180

[56] References Cited

U.S. PATENT DOCUMENTS

| | | | |
|---|---|---|---|
| 898,456 | 9/1908 | Farnham . | |
| 936,757 | 10/1909 | Butts . | |
| 1,547,562 | 7/1925 | Byrd | 422/100 |
| 1,762,807 | 6/1930 | Arnold . | |
| 2,664,752 | 1/1954 | Southwick | 422/100 |
| 2,697,945 | 12/1954 | Dovas | 422/100 |
| 3,058,352 | 10/1962 | Graham et al. | 73/427 |
| 3,441,384 | 4/1969 | Morrill | 23/292 |
| 3,660,037 | 5/1972 | Sokol | 422/100 |
| 4,007,639 | 2/1977 | Haeckel | 73/425.4 |
| 4,210,156 | 7/1980 | Bennett | 128/763 |
| 4,483,825 | 11/1984 | Fatches | 422/100 |

FOREIGN PATENT DOCUMENTS

| | | | |
|---|---|---|---|
| 377057 | 6/1923 | Fed. Rep. of Germany | 422/100 |

*Primary Examiner*—Robert J. Hill, Jr.
*Assistant Examiner*—Lyle Alfandary Alexander
*Attorney, Agent, or Firm*—Fish & Richardson

[57] ABSTRACT

A graduated pipette having a known total delivery volume, suitable for accurately dispensing both known large and known small volumes of a fluid, wherein the small volume is less than one fourth of the delivery volume of the pipette, the pipette comprising: an upper and a lower elongated tube joined together to form a single continuous unit, the upper tube having a different internal diameter from the lower tube, the upper tube having coarse indicia suitable for accurately dispensing the large volume, wherein the coarse indicia are labelled from zero ml to the volume of the upper tube, the lower tube having fine indicia suitable for accurately dispensing the small volume, wherein the fine indicia are labelled from zero ml to the volume of the lower tube, wherein the upper tube comprises a mouthpiece suitable for allowing fluid to be sucked up into the unit, and the lower tube comprises a constricted region suitable to allow accurate control of fluid flow from the unit, wherein the fluid is accurately dispensed from the unit only through the constricted region.

12 Claims, 2 Drawing Sheets

DILUTION PIPETTE DEVICE

BACKGROUND OF THE INVENTION

This invention concerns pipettes suitable for delivering precise volumes of fluid.

In laboratory experiments in the fields of chemistry, microbiology and biochemistry, it is often necessary to transport an exact quantity of fluid from one vessel to another. Depending on the nature of the experiment being conducted, the quantity of fluid added or removed is very often critical, and a mistake in quantity can lead to confusing, if not erroneous or detrimental, results. Where the quantities of fluid are relatively small, pipettes are utilized to facilitate the addition or removal of the fluid.

The typical prior art graduated dispensing pipette consists of a hollow cylindrical glass or plastic tube. A scale is very often etched, printed, or otherwise placed on the surface of the tube. The pipette scale correlates the height of the fluid column to the quantity of fluid to be dispensed therefrom. The pipette is used by applying suction to its top end, or mouthpiece, allowing an excess quantity of fluid into the pipette and then allowing the fluid to drain to the desired level. By placing a finger over the mouthpiece the user creates a pressure differential across the fluid column and prevents escape of the fluid until the finger is removed. The user can control the rate of flow through the pipette by varying the pressure which his finger exerts on the mouthpiece. Further, the bottom end of the tube, or pipette tip, is typically constricted to control the exit flow rate of the fluid.

Graduated dispensing pipettes, e.g., serological pipettes, are manufactured with specified internal barrel diameters (IDs). The ID determines the volume contained within a given length pipette and therefore sets the spacing between the volumetric graduation markings on the pipette. A number of commercial serological pipettes are available to deliver maximum volumes of either 0.1, 0.2, 1.0, 2.0, 5.0, 10.0, 25.0, or 50.0 milliliters of fluid.

Farnham, U.S. Pat. No. 898,456, describes a double-ended tube for measuring volumes of medicine. The tube has one half calibrated in drops and the other half calibrated in teaspoons. In use, the tube "is changed end for end" when the user desires to measure drops rather than teaspoons, or vice versa.

Graham et al., U.S. Pat. No. 3,058,352, describes a standard pipette for accurately measuring 5 ml of fluid. The pipette has a conical delivery end, not calibrated for accurate measurement, and a cylindrical neck at the other end to allow control of fluid delivery by a person's hand.

Morrill, U.S. Pat. No. 3,441,384, describes a pipette having a relatively flat cross section so that more accurate volumes of fluid may be delivered.

Bellco Glass Inc. in a 1978 product catalog, offers a large diameter 25 ml graduated pipette having a lower portion of a reduced diameter to allow entry and "removal of media from all standard plastic culture flasks" (such flasks have restricted neck openings).

SUMMARY OF THE INVENTION

In a first aspect, the invention features a "two in one" or "hybrid" graduated pipette having a known total delivery volume, and method for using the pipette. The pipette is suitable for dilution operations, and for dispensing, with improved accuracy, both known large and known small volumes of a fluid. The graduated small volume is less than one fourth of the nominal (named) volume of the whole pipette. The pipette includes contiguous upper and lower elongated tubes having differing IDs, and having either the same or differing outer diameters (ODs), joined together to form a unit. The upper and lower tubes are each separately graduated beginning with zero volume graduation marks to allow dispensing to begin from those respective points. The upper tube is suitable for accurately dispensing a large volume and has coarse indicia of volume, and the lower tube is suitable for accurately dispensing a small volume, and has fine indicia of volume. The pipette is thus scaled, graduated and numbered for performing accurate and convenient decimal dilutions of liquids where previously two pipettes were typically used. The upper tube is provided with a mouthpiece suitable for allowing fluid to be sucked up into the unit, and the lower tube is provided with a constricted region suitable for allowing accurate control of fluid flow from the unit. Fluid is accurately dispensed only through this constricted region.

In preferred embodiments, the upper and lower tubes are detachably secured together by a connector; the graduated small volume is either 10% or 20% that of the nominal volume of the pipette, the numbered graduations on the lower unit are 10-fold smaller in volume than in the upper unit and the lower tube contains a graduated volume either 10% or 20% that of the nominal volume of the total pipette; both the upper and lower tubes are individually suitable for use as pipettes alone; the pipette is formed from extruded or blown plastic or glass; the large volume if from 5 to 20 ml, most preferably 5 to 10 ml, and the small volume is from 0.5 to 2 ml, most preferably 1 to 2 ml; and the upper and lower tubes have a continuity of calibration marked by indicia to allow accurate continuous dispensions of both large and small volumes of fluid through the junction region or junction point of the upper and lower tubes. In other preferred embodiments, the upper and lower tubes are permanently secured together; the upper and lower tubes have differing IDs but the same OD for maximizing strength of the pipette and facilitating storage and packing of the pipettes, or the lower tube has a smaller ID and OD than the upper tube for reasons of maintaining a fairly constant wall thickness in both the upper and lower tubes.

In a related aspect, the invention features a kit including the upper and lower units and the connector described above In preferred embodiments, the kit includes a plurality of upper or lower tubes, each upper or lower tube being different, wherein the unit can be formed by joining any two or more of the upper and lower tubes.

Pipettes of this invention provide improved accuracy for dispensing relatively small volumes from relatively large pipettes. Thus, for example, a 10 ml pipette can be used to accurately dispense 0.2 ml as well as 10 ml of fluid. Further, in preferred embodiments, the pipettes have a two piece construction and can be separated to form two physically distinct pipettes which can be utilized separately as pipettes. The modular design also allows the length of a pipette to be adjusted (by adding more units) and thus allows otherwise inaccessible fluids to be retrieved from large flasks or bottles.

Another advantage of the pipette design is in the saving of consumables, i.e., sterile disposable pipettes. That is, the pipettes may be used in a series of dilution and measuring operations involving both small and large volumes, without compromising the accuracy of individual measurements. Thus, one pipette can be used where two conventional pipettes would otherwise be needed. This factor improves the control of sterile operating conditions because fewer pipette changing operations generate fewer incidents of accidental contamination.

Other features and advantages of the invention will be apparent from the following description of the preferred embodiments and from the claims.

BRIEF DESCRIPTION OF THE DRAWINGS

The Figures will first briefly be described.

DESCRIPTION OF THE PREFERRED EMBODIMENTS

Figure 1:
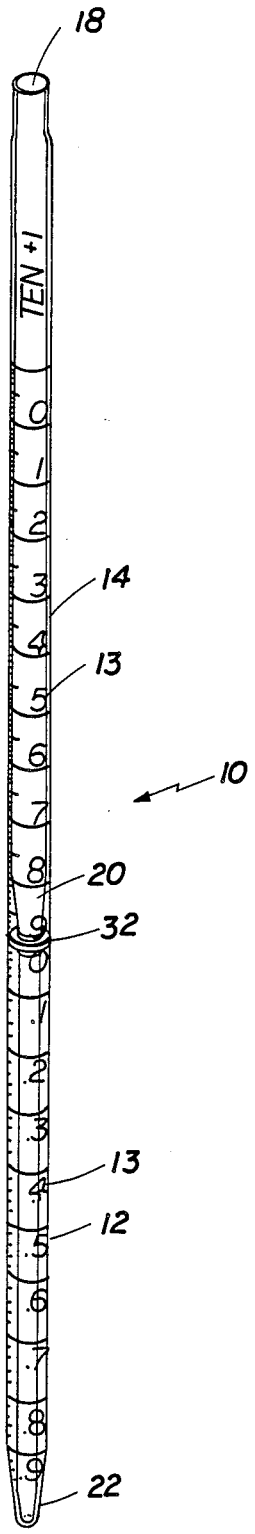
FIGS. 1 and 2 are diagrammatic representations of two pipettes.

Referring to FIG. 1, "TEN+1" pipette 10 is constructed from a lower unit 12 and an upper unit 14, both formed from either plastic or glass. In plastic, the pipette is preferably highly transparent for example, polystyrene, and may be sterilized for example, by gas or radiation, or it is resistant to organic chemicals and to heat, for example, polypropylene. Upper unit 14 is generally an elongated cylinder, sized to hold about 9 ml of fluid, having a mouthpiece 18 suitable for allowing fluid to be sucked up into pipette 10, and subsequently released in controlled fashion. Also provided is a partially conical constricted region 20 suitable for allowing connection of upper unit 14 with lower unit 12. Indicia 13 of volume are provided on both units 12 and 14. These indicia are in 0.1 ml increments on upper unit 14 and 0.02 ml increments on lower unit 12.

Lower unit 12 is also a generally elongated cylinder of smaller inner cross sectional dimension than upper unit 14, having a partially conical constricted region 22. The OD of lower unit 12 may be the same or may be smaller than upper unit 14. Stacking and handling of the pipette is facilitated by a uniform OD or non stepped OD along the length of pipette 10.

Figure 2:
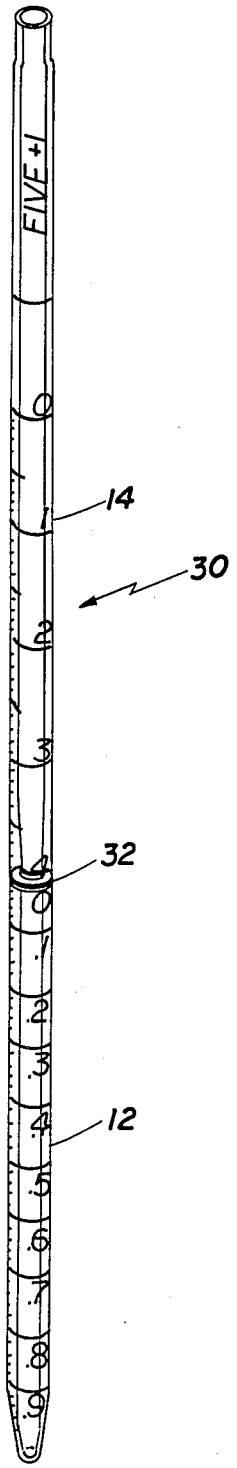

Referring to FIG. 2, "FIVE+1" pipette 30 is similar in construction to "TEN+1" pipette 10 except that upper unit 14 is suitably sized to hold about 4 ml.

Figure 3:
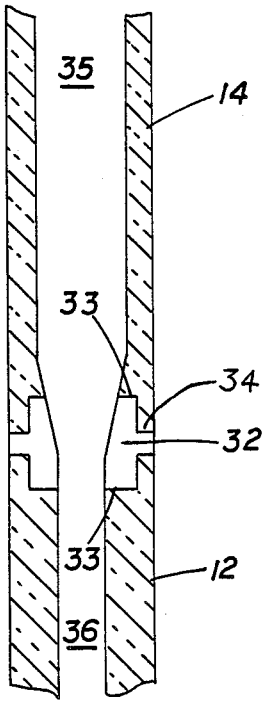
FIG. 3 is a partial longitudinal section through the region joining two parts of a pipette.

Referring to FIG. 3, upper unit 14 and lower unit 12 may be welded together by standard techniques to form a continuous plastic or glass pipette. Alternatively, a generally cylindrical connector 32 is provided having a disc-like projection 34 against which upper and lower units 12, 14 are tightly positioned. Connector 32 and units 12, and 14 are shaped and sized to provide a friction fit to hold units 12 and 14 firmly together. Thus, lower unit 12 and upper unit 14 have circular notches 33 formed to match the outer shape of connector 32. Further, connector 32 is shaped to provide a continuum between the internal bores 35, 36 of both units so that the fluid volume calibration of these units can be matched. That is, a large volume of fluid can be accurately dispensed from upper unit 14, together with a small volume of fluid dispensed from lower unit 12. For example, to dispense 9.70 ml, pipette 10 is filled with fluid until the meniscus lies against marking 'O' on upper unit 14. The fluid is then allowed to run out of pipette 10 until the meniscus lies against marking 0.70 ml on lower unit 12.

Pipette 10 has a length comparable to a conventional 10 ml serological pipette but has a two part barrel in which upper unit 14 has a larger ID than lower unit 12 Upper unit 14 is designed to accurately deliver a volume or several volumes of fluid which are substantially larger than those volumes delivered from lower unit 12. Accordingly, pipettes 10 and 30 have been constructed to deliver a total of 10 or 5 ml of fluid, 9 or 4 ml from upper unit 14, and a maximum of 1.0 ml from lower unit 12.

For example, in pipette 10, upper unit 14 is approximately ⅔ the length of a conventional 10 ml serological pipette. Therefore, to hold a comparable volume the ID of upper unit 14 is approximately 20% greater than the ID of a corresponding 10 ml conventional pipette. The lower ⅓ of pipette 10 is designed to hold 1.0 ml. This is achieved by using a lower unit ID approximately 30–45% that of the upper unit ID. In a similar design, pipette 30, the ID of the lower unit (holding 1.0 ml) is approximately 40–55% that of the upper unit. The OD of the lower unit is not material to this invention. However if the OD of the entire pipette is uniform while the wall thickness of the upper and lower tubes differs, the pipettes may be easily stacked and handled.

Assembly

Pipettes 10 and 30 are preferably provided as a sterile kit, either pre assembled or ready for assembly. Thus, the kit includes upper and lower units 12 and 14, and connector 32. In addition, other units of various sizes may be provided to allow a user to choose the most suitable combination. Each unit can be used individually as a conventional pipette, but preferably two units are fixed together using connector 32. The friction fit of these units and connectors is sufficient to hold the pipette together as a single device. After use, any one unit may be exchanged for other units as desired, or disposed of by standard procedures.

Use

To illustrate the use of standard serological pipettes, the following example is useful. A standard 10 ml serological pipette is filled with culture medium. Five milliliter portions of the 10 ml of medium are dispensed into a set of culture tubes. Subsequently a separate standard 1.0 ml serological pipette is utilized to deliver, and thereby dilute, 0.20 ml portions of a cell suspension into each of the above culture tubes. Thus, this experiment uses two pipettes to create cell suspension dilutions. This example requires two pipetting operations and the utilization of two sizes of pipettes (a 10 ml and a 1.0 ml). Since, as a matter of convenience, many research and clinical laboratories utilize pre sterilized disposable glass or plastic serological pipettes, the above cell dilution operation consumes two disposable pipettes.

The serological pipettes of this invention have been designed to permit usage of a single pipette where formerly two separate conventional pipettes of different fluid capacities were required. For example, the culture medium described above is first dispensed into all of the tubes, then, using the same pipette a small volume of cell suspension is delivered to each tube.

The pipette of this invention allows one to dispense fluid volumes with approximately 10-fold greater reading accuracy at small volumes than is possible with a single large volume conventional pipette. For example a conventional 10 ml pipette has numerical graduations every 1.0 ml and markings every 0.1 ml whereas a 10 ml pipette of this invention, in addition to these markings, will also have numerical graduations every 0.1 ml and markings every 0.01 or 0.02 ml within the 1.0 ml lower unit of the instrument. This extended accuracy range allows bifunctional use of pipettes in dispensing, for example, both sample concentrates and fluid diluents (such as, cell suspension concentrates and culture medium diluents).

Other Embodiments

Other embodiments are within the following claims. For example, other serological pipette designs are possible, where at least two cylindrical barrel sections having different IDs and lengths are combined. Other types of conventional graduated dispensing pipettes which are substantially cylindrical in diameter (such as Mohr pipettes, Dye Industry pipettes, graduated Lambda Micropipettes, and graduated Pasteur pipettes) may also be constructed to form hybrid pipettes, as described above. Hybrid multi-range pipettes as described by this invention may include more than two end to end cylindrical sections having different internal diameters.

I claim:

1. A graduated pipette having a known total delivery volume, suitable for accurately dispensing both known large and known small volumes of a fluid, wherein said small volume is less than one fourth of the delivery volume of said pipette, said pipette consisting of:

an unobstructed upper and a lower elongated tube joined together to form a single continuous unit open at both ends, said upper tube having a different internal diameter from said lower tube, said upper tube having coarse indicia suitable for accurately dispensing said large volume, wherein said coarse indicia are labelled from zero ml to the volume of said upper tube, said lower tube having fine indicia suitable for accurately dispensing said small volume, wherein said fine indicia are labelled from zero ml to the volume of said lower tube, wherein said upper tube comprises a mouthpiece suitable for allowing fluid to be sucked up into said unit, and said lower tube comprises a constricted region suitable to allow accurate control of fluid flow from said unit, wherein said fluid is accurately dispensed from said unit only through said constricted region.

2. A graduated pipette having a known delivery volume, suitable for accurately dispensing both known large and known small volumes of a fluid, wherein said small volume is less than one fourth of the delivery volume of said pipette, said pipette consisting of:

an unobstructed upper and a lower elongated tube joined together to form a single continuous unit open at both ends, said upper tube having a different internal diameter from said lower tube, said upper tube having coarse indicia suitable for accurately dispensing said large volume, said lower tube having fine indicia suitable for accurately dispensing said small volume, wherein said upper tube comprises a mouthpiece suitable for allowing fluid to be sucked up into said unit, and said lower tube comprises a constricted suitable to allow accurate control of fluid flow said unit, wherein said fluid is accurately from said unit only through said constricted wherein said upper and lower tubes are detachably secured together by a connector.

3. The pipette of claim 1 or 2 wherein the outer diameter of said upper and said lower tubes are the same.

4. The pipette of claim 1 or 2 wherein said pipette has a nominal delivery volume, and said small volume is 10% or 20% of said nominal volume.

5. The pipette of claim 1 or 2 wherein said fine indicia represent 5 or 10-fold smaller volumes than said coarse indicia.

6. The pipette of claim 1 wherein both said upper and lower tubes are individually suitable for use as a pipette.

7. The pipette of claim 1 wherein said lower unit and said upper unit are formed from plastic or glass.

8. A kit consisting of said upper and lower tubes and said connector of claim 2.

9. The pipette of claim 1 wherein said large volume is from 5 ml to 20 ml and said small volume is from 0.5 ml to 2 ml.

10. The pipette of claim 9 wherein said large volume is from 5 ml to 10 ml, and said small volume is from 1 ml to 2 ml.

11. The pipette of claim 1 wherein said upper and lower tubes have a continuity of calibration marked by said indicia to allow continuous accurate dispensing of both said large and small volumes of said fluid.

12. The pipette of claim 11 wherein said pipette graduations are numbered, said graduations on said lower tube being 10-fold smaller than said graduations on said upper tube.

* * * * *

UNITED STATES PATENT AND TRADEMARK OFFICE

CERTIFICATE OF CORRECTION

PATENT NO. : 4,877,585

DATED : October 31, 1989

INVENTOR(S) : Daniel Perlman

It is certified that error appears in the above-identified patent and that said Letters Patent is hereby corrected as shown below:

In the Claims:

Column 6, line 16, insert -- region -- after "constricted".

Column 6, line 17, insert -- from -- after "flow".

Column 6, line 18, insert -- dispensed -- after "accurately".

Column 6, line 19, insert -- region, -- after "constricted".

Signed and Sealed this

Nineteenth Day of November, 1991

*Attest:*

HARRY F. MANBECK, JR.

*Attesting Officer*

*Commissioner of Patents and Trademarks*